US006422409B2

(12) United States Patent
Kofod

(10) Patent No.: US 6,422,409 B2
(45) Date of Patent: Jul. 23, 2002

(54) COLLAPSIBLE CONTAINER WITH AN UNBROKEN TOP WALL

(75) Inventor: Bent Kofod, Kalundborg (DK)

(73) Assignee: Carrimor, Hadersler (DK)

( * ) Notice: Subject to any disclaimer, the term of this patent is extended or adjusted under 35 U.S.C. 154(b) by 0 days.

(21) Appl. No.: 09/864,323

(22) Filed: May 25, 2001

Related U.S. Application Data

(63) Continuation of application No. PCT/DK99/00656, filed on Nov. 25, 1998.

(51) Int. Cl.[7] ..... B65D 90/62
(52) U.S. Cl. ..... 220/7; 220/813; 220/7
(58) Field of Search ..... 220/811, 812, 220/813, 6, 7, 4.28

(56) References Cited

U.S. PATENT DOCUMENTS

| | | | | |
|---|---|---|---|---|
| 3,635,368 A | | 1/1972 | Winsor | 220/6 |
| 3,995,764 A | * | 12/1976 | Zagami | 220/263 |
| 4,646,928 A | | 3/1987 | Ono et al. | 220/6 |
| 5,056,667 A | | 10/1991 | Coogan | 206/600 |
| 5,755,351 A | * | 5/1998 | Kruzick | 220/326 |

FOREIGN PATENT DOCUMENTS

| | | |
|---|---|---|
| DE | 195 01 111 A1 | 7/1996 |
| EP | 0 511 781 B1 | 9/1995 |
| GB | 2 170 183 A | 7/1986 |
| WO | WO 91/12999 | 9/1991 |
| WO | WO 93/06017 | 4/1993 |
| WO | WO 97/31832 | 9/1997 |

OTHER PUBLICATIONS

International Search Report, PCT DK99/00656, dated Feb. 18, 2000.
Danish Search Report, (DK PA 1998 01553), dated Aug. 12, 1999.

* cited by examiner

*Primary Examiner*—Stephen Castellano
(74) *Attorney, Agent, or Firm*—Pennie & Edmonds LLP

(57) ABSTRACT

A collapsible container includes a base frame, four side sections pivotally connected to the side edges of the base frame, and a top wall The top wall is formed as an unbroken wall extending in the raised position of the container between the top edges of the side walls. The top wall closes the container. The top wall is connected to one of the side walls in such a way that it in a combined pivoting and displacing movement can be guided back and forth between the closed position and a position in which the top wall is hanging down along the exterior of the side wall in the upright position.

10 Claims, 6 Drawing Sheets

COLLAPSIBLE CONTAINER WITH AN UNBROKEN TOP WALL

CROSS-REFERENCE TO RELATED APPLICATIONS

This application is a continuation of copending International Application No. PCT/DK99/00656, filed Nov. 25, 1998.

FIELD OF THE INVENTION

The invention relates to a collapsible container for transporting a load. More particularly, the invention relates to a mainly rectangular base section, four side sections pivotally connected to the four sides of the base section, and a top section pivotally connected to a first side section. The sections are adapted to pivot in relation to each other between a first position in which they extend in rows mainly parallel across each other, and a second position in which they jointly are define a chamber for containing a load.

BACKGROUND OF THE INVENTION

Collapsible containers are used to a great extent for transporting a load from one place to another. The load can consist of goods or a liquid. In the latter case, the liquid is transported in a bag-shaped liner which is supported by the container. When the container has been emptied, it is returned in a collapsed state whereby a considerable saving in the transportation costs is obtained.

From WO 97/31832 is known a collapsible container having a four-sided base including a base pallet mounted detachably to a base frame supporting a base panel. A pair of lid halves are hinged to the uppermost edges of the first and second side walls on floating hinges, which allow the lid halves to pivot to a collapsed position in which they are flush with the outer surfaces of the first and second side walls. The container is an IBC bag-in-the-box-type container with a top section, which is divided into two parts.

WO 91/12999 concerns a box-shaped transport cart where the top part of the cart is a specially designed top shelf. When this detachably mounted shelf is in its horizontal position, the front edge and profile member side portions will enclose the upper front corners of the cart, keeping them together and providing protection.

The known collapsible containers typically have a pallet-like base frame with hinges for pivotal mounting of the side sections. In a collapsed state, the side sections will therefore lie stacked on top of the base frame and in the unfolded state, that is upright state, they are normally locked together along adjacent sides for being able to absorb the pressure of the load.

The top section of the known collapsible containers is hinged onto one of the side sections. However, the top section is often of relatively large size and is therefore unhandy and difficult to pivot when the container is to be raised or collapsed. In. order to facilitate this operation, the top section is therefore divided into at least two hinged parts so that operations can take place in at least two successive steps.

However, this structure is costly, and difficult and time-consuming to operate, as the necessary unfolding and subsequent collapsing of the parts of the top section require extra working operations. The strength and stability of the top wall are also reduced by the division of the top wall into hinged parts.

The object of the invention is to provide a collapsible container of the kind mentioned in the opening paragraph that has a strong and stable top section and that is easier and quicker to operate than hitherto known when the container is to be raised or collapsed.

SUMMARY OF THE INVENTION

The novel and unique features according to the invention, whereby this is achieved, is the fact that the top section is constructed as an unbroken top wall which in the second position of the sections, extends between the top edges of the side sections, and this unbroken top wall is adapted to describe a combined pivoting and displacing movement when it is guided between the second position and a third position in which the top wall extends mainly parallel to the corresponding side section in the second position of this section. Thereby, in an easy and quick manner using e.g. only one hand and in one single sliding movement, the top section can be guided between its final position in which it closes the container at the top and to its position along the first side section.

According to the invention, these movements are guided by means of at least one guide rod which pivotally connects the first side section to an area at the side of the top wall that adjoins the top side of the first side section in second position, and at least one pivoting guide placed topmost on the first side section for accommodating a corresponding slide constructed on the top wall and extending in the same direction as the direction in which this top wall is moved between the second and third position.

In order to obtain a simple and stable guided structure, a guide rod can be pivotally placed in the middle of both of the upright sides of the first side section in the second position and at the top can be placed an angular pivoting guide, one leg of which extends across a slide in the form of a projecting flange constructed on the top wall.

When the top wall is lifted from its third position, its lower end thereby describes a circular arc in a guided manner while the rest of the top wall is swung upwardly at the same time as it is pushed further and further in through the pivoting guides which during this slidingly are holding the top wall in place.

Each guide rod can advantageously be pivotally connected to the top wall by means of an axle journal constructed on the guide rod and journaled in a bearing in the form of a U-shaped clamp placed on the lower side of the top wall and the length of which is longer than the transverse size of the axle journal. Thereby, the top wall can at dismounting conveniently be pulled free a little of its final position over the container before the pivot connection of the guide rod and the top wall effectively starts functioning and guides the movement of the top wall the rest of the way.

In the terminal phase, the top wall is moving in an almost translatory manner closely across the top sides of the upright side sections. This characteristic feature according to the invention is advantageously utilized for locking the top wall in its final position as catches constructed on the top wall are pushed into engagement with the first side wall whereas the top wall itself is pushed into engagement with catches constructed on the top side of the other side sections.

The catches on the two side sections that are perpendicular to the first side section in the second position can be formed as hooks which engage with inclined slots in the projecting flanges of the top wall in such a way that the two side sections are fixed to each other by the top section.

On the top section can furthermore be placed a lock that engages with lock fittings topmost on the opposite side of the first side section in such a way that the top wall clamps this side to the first side when the lock is activated.

BRIEF DESCRIPTION OF THE DRAWINGS

The invention will be explained in greater detail below, describing only exemplary embodiments with reference to the drawing, in which.

DETAILED DESCRIPTION OF THE EMBODIMENTS

Figure 1:
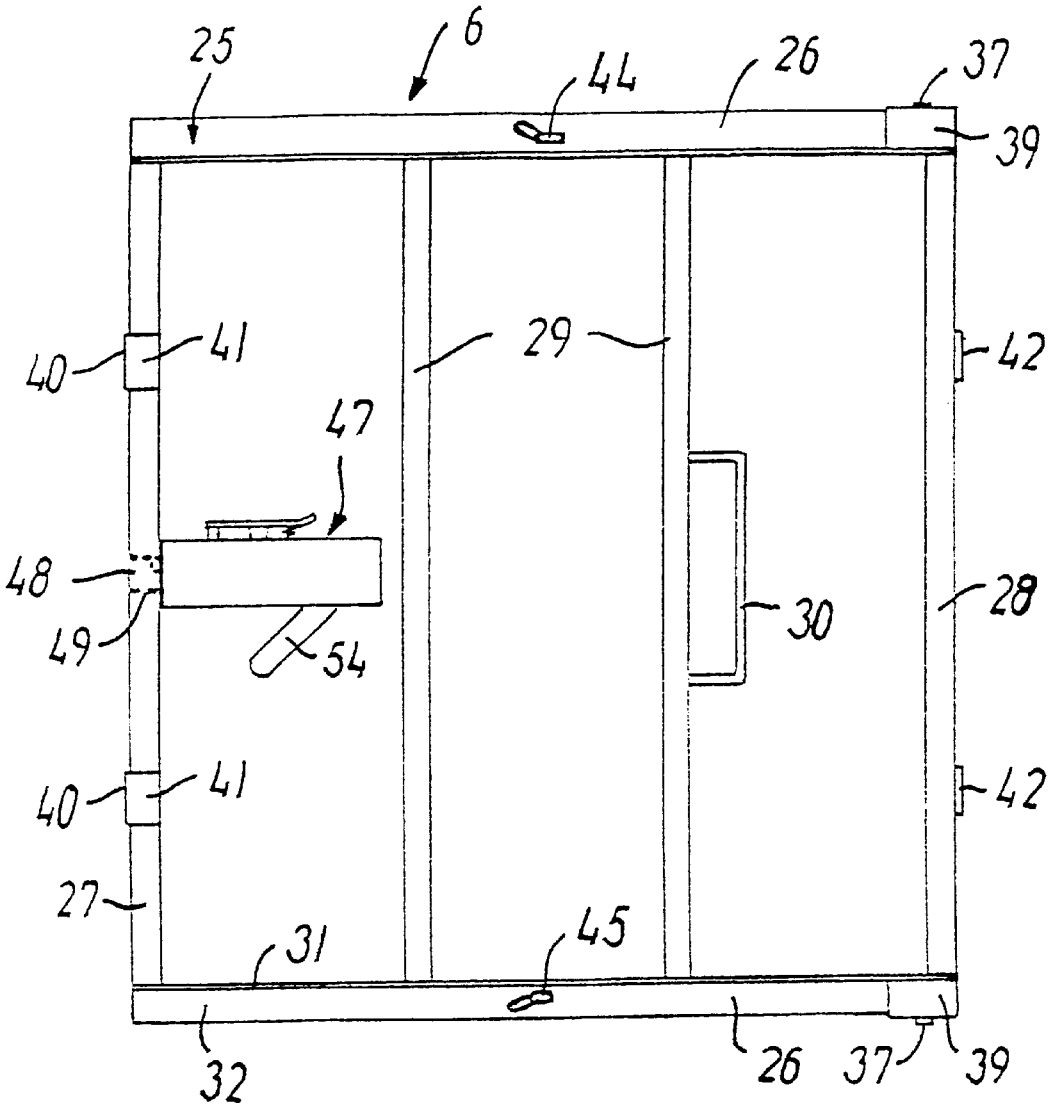
FIG. 1 is a plan view of a collapsible container according to the invention.
Figure 2:
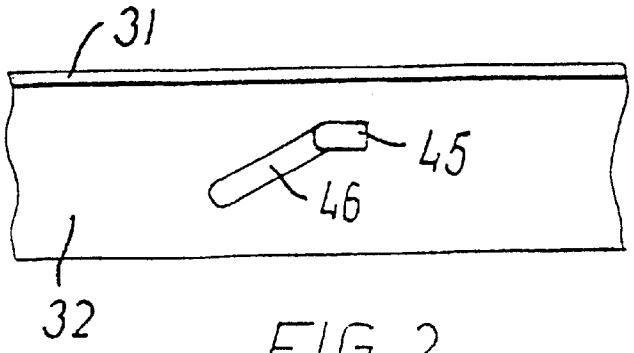
FIG. 2 shows on a larger scale a detail of the collapsible container.
Figure 3:
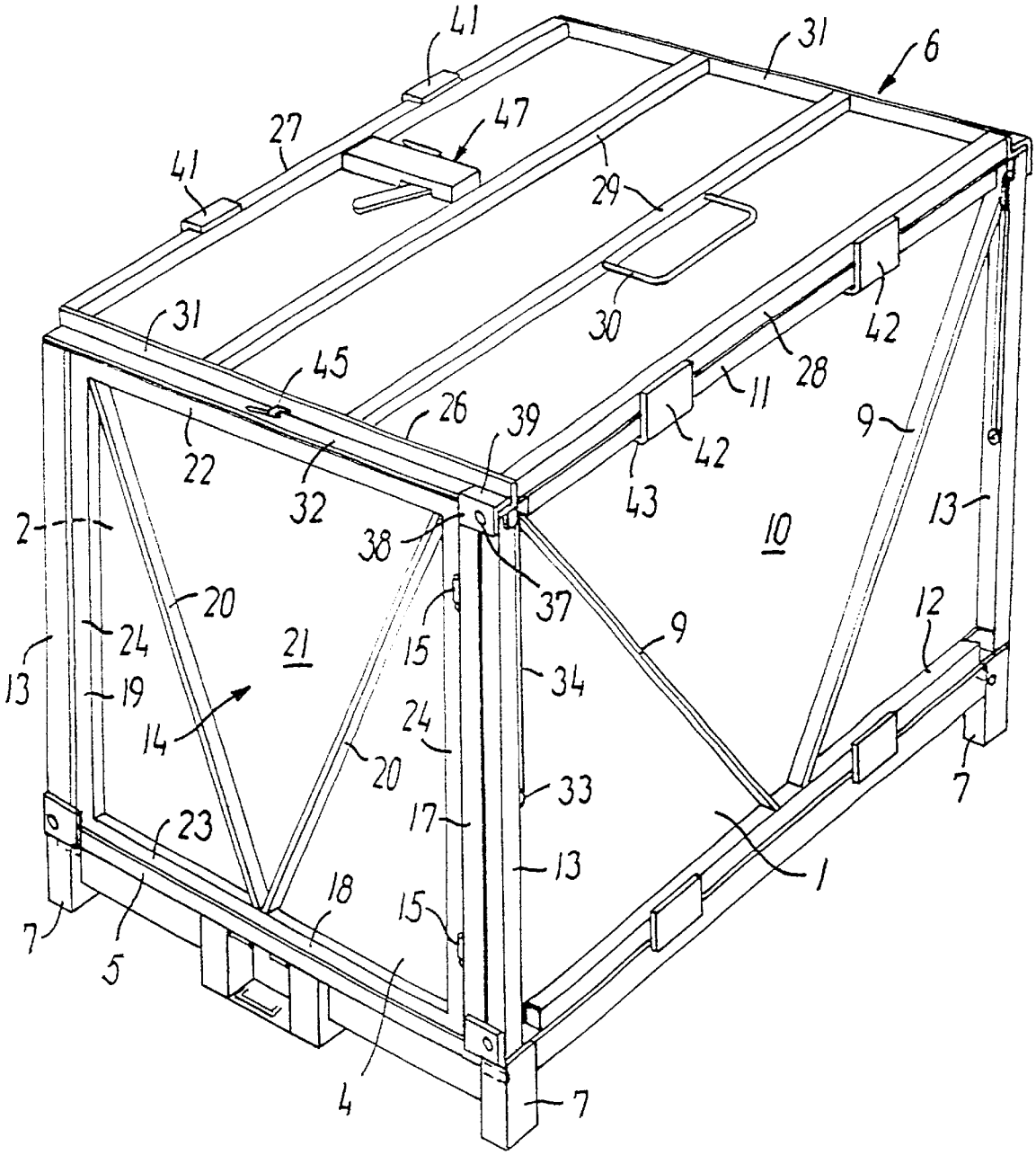
FIG. 3 is a perspective oblique plan view from the right of the collapsible container in FIG. 1.

The collapsible container in FIGS. 1 and 3 comprises four side walls 1,2,3,4 pivotally mounted on a base frame 5 and furthermore a top wall 6 for closing the container at the top.

The base frame 5 is formed as a pallet having legs 7 allowing insertion of the fork arms of a fork-lift truck (not shown) under the base frame so that the fork-lift truck can lift the container.

The collapsible container is of the kind that can be collapsed in an empty state so that the side sections and the top section will lie in a stack on top of the base frame normally with the top section topmost. In this collapsed state, the container occupies relatively little space whereby a considerable reduction in the costs for transporting the empty container is obtained.

In the shown case, the side walls 1, 2 and 3 are each constructed around a rectangular bar frame 8 with obliquely placed reinforcing bars 9 and plate-shaped panels 10. Seen from the upright position in FIGS. 1–5, the rectangular bar frame of the side walls consists of an upper bar 11, a lower bar 12 and two side bars 13.

The side wall 4 is constructed in a slightly different way than the rest of the side walls 1, 2 and 3, the side wall in this case having a door 14 side-hinged on the vertical leg 17 of an L-shaped bar with hinges 15. The second leg 18 of this bar is in its turn pivotally connected to the base frame 5.

The door is just as the side walls 1, 2, and 3 constructed around a rectangular bar frame 19 with obliquely placed reinforcing bars 20 and plate-shaped panels 21. The rectangular bar frame 19 of the door consists of an upper bar 22, a lower bar 23 and two side bars 24.

This door arrangement is described in details in the applicant's Danish patent application, entitled "Collapsible container for transporting a liquid," which was filed at the same time as this one and which is incorporated in the present Danish patent application by reference thereto.

The collapsible container can furthermore be of any kind known per se and will therefore not be described any further here.

The top wall 6 in FIG. 1 is constructed around a bar frame 25 with two angular side bars 26, a front end bar 27, a back end bar 28 and two central bars 29 with a handle 30. The two angular side bars 26 each have a vertical flange 31 and a horizontal flange 32, seen from the raised position of the container.

Figure 6:
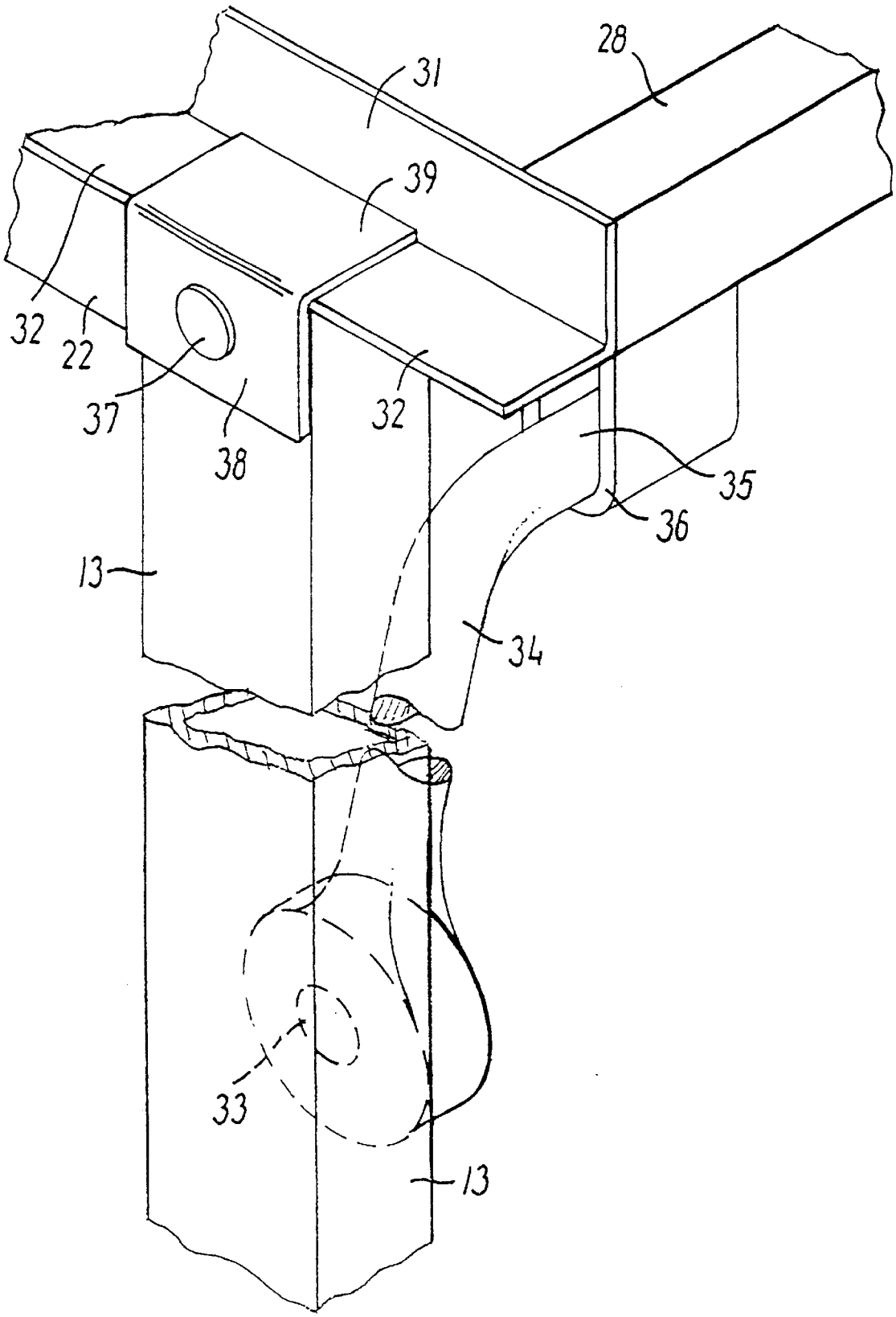
FIG. 6 is on a larger scale a tractional side view of a detail of a pivoting device for guiding the movement of the top section.

As it can be seen, the top wall 6 consists of an unbroken, plate-shaped wall connected to the side wall 1 in a way described in detail below with reference to FIG. 6.

In the middle of each side bar 13 of the side wall 1 and pivotally about a swivel pin 33 is placed a guide rod 34 which at the opposite end has an axle journal 35 pivotally journaled in a bearing in form of a U-shaped, oblong clamp 36 placed on the underside of the top wall and having a greater length than the transverse size of the axle journal.

Topmost on each of the side bars 13 of the side wall 1 and pivotally about a swivel pin 37 is furthermore placed an angular pivoting guide 38, the upper flange 39 of which overlaps the horizontal flange 32 on the angular side bar 26 of the top wall.

Figure 4:
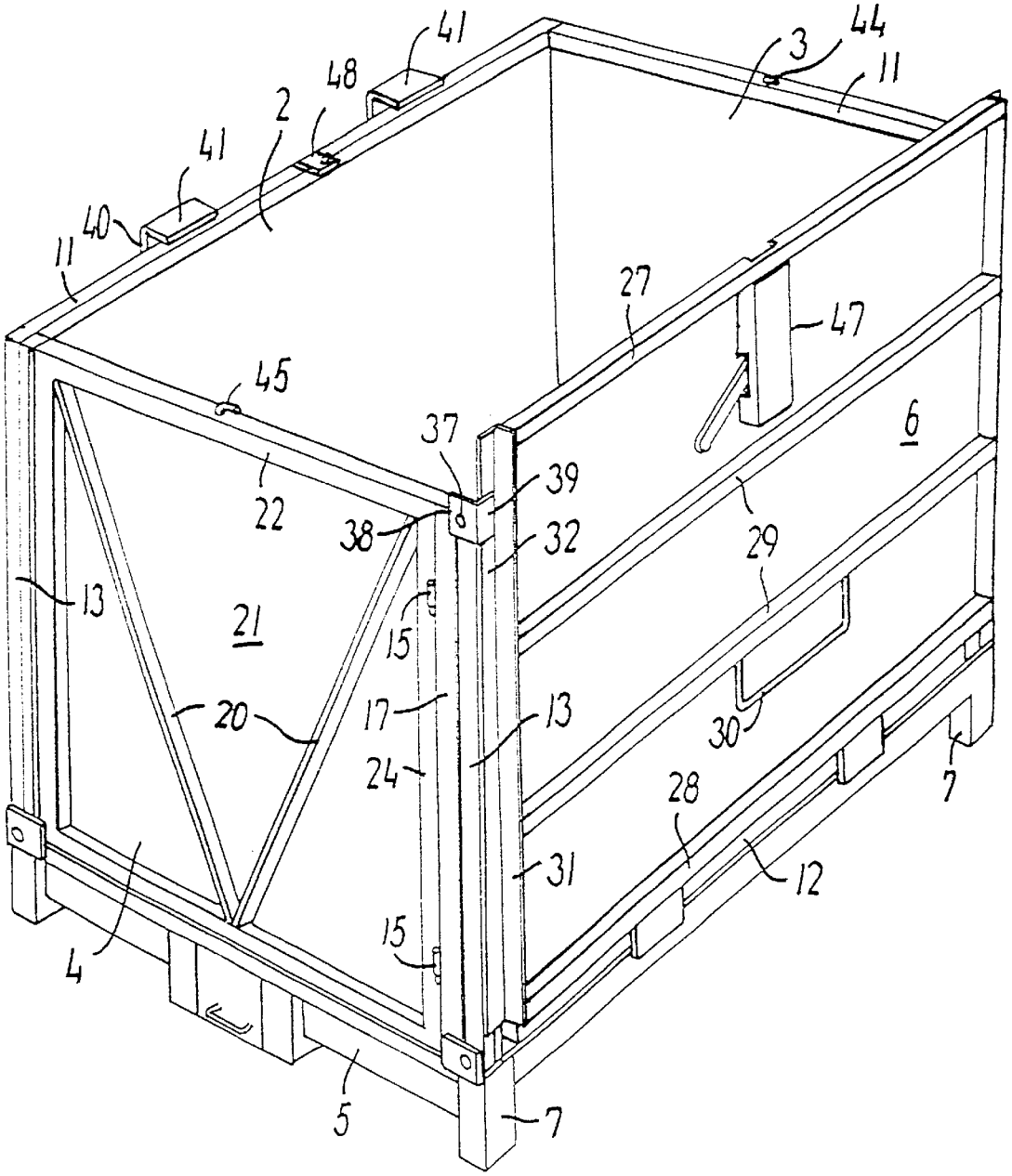
FIG. 4 is the collapsible container in FIG. 1, but with a top section bent down along the right side.

In FIG. 4, the top wall 6 is hanging in the guide rods 34 along the exterior of the side wall 1, the top wall being kept in position at the top by the grasp of the pivoting guide around the horizontal flange 32 on the angular side bar 26 of the top wall.

Figure 5:
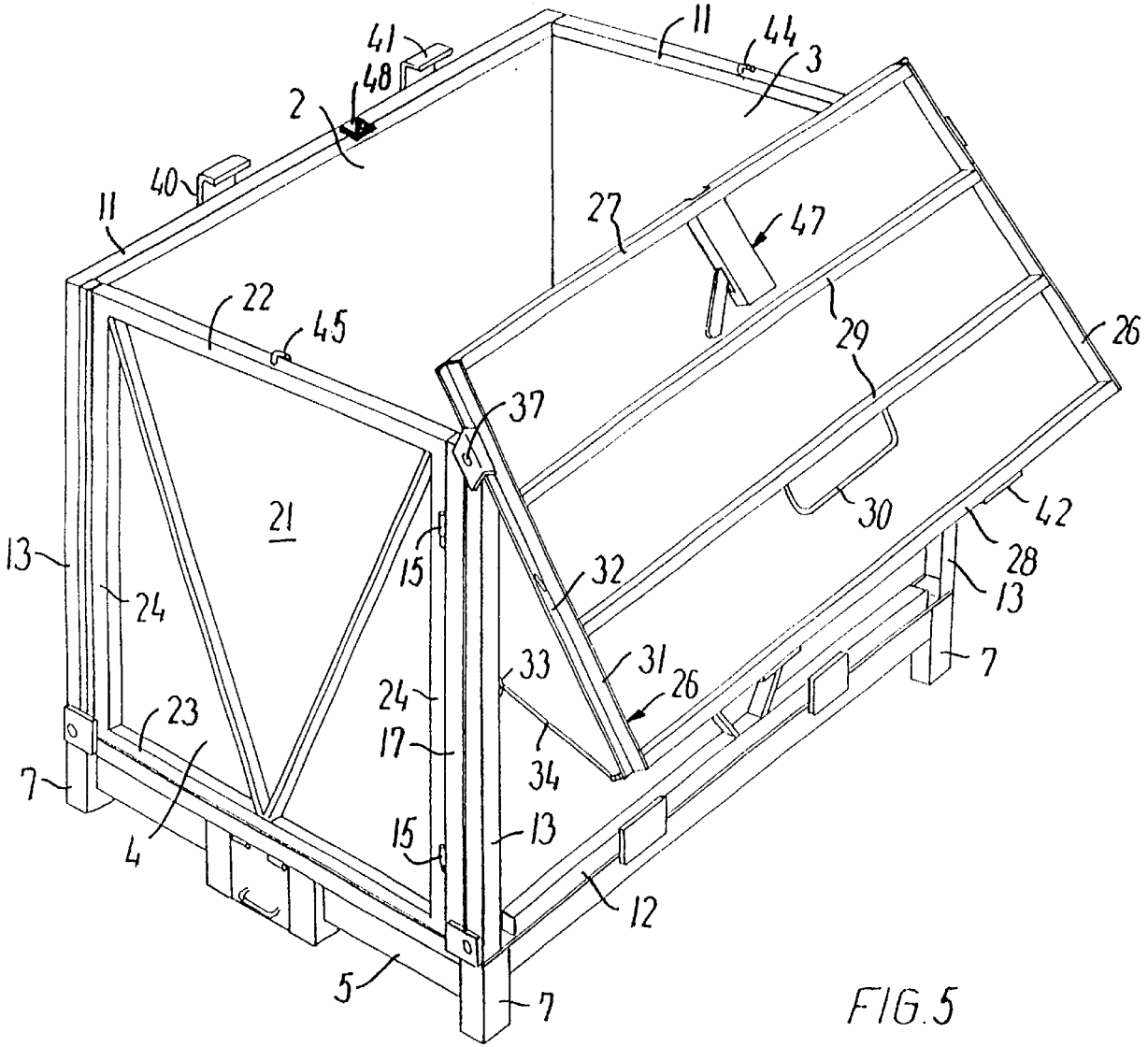
FIG. 5 shows a stage of the movement of the top section shown in FIG. 4 between the position in FIG. 4 and the one in FIGS. 2 and 3.

In FIG. 5, the operator (not shown) has with a grip on the handle 30 lifted the top wall 6 which during this is guided in its movement by the guide rods 34 and the angular pivoting guides 38. The lower end of the top wall describes a circular arc while the rest of the top wall is swung upwardly in the direction of the arrow at the same time as it is pushed further and further in through the pivoting guides 38, the horizontal flanges 32 of the angular side bars 26 during this acting as slides that slidingly are displaced in the pivoting guides. In FIG. 3, the top wall 6 is now guided all the way to its final position where it closes the container at the top.

When the container is to be collapsed again, the same operation is carried out only in reverse order, the operator during this starting by pulling the top wall 6 back in a mainly almost translatory, horizontal movement. As mentioned earlier, the engagement of the guide rod 34 with the rear end of the top wall via the oblong clamp 36 will cause this end to describe a circular movement. As the axle journal 35 of the guide rod can be displaced a distance in the oblong clamp, the above translatory movement of the top wall is allowed initially before the engagement between the guide rod and the top wall effectively starts functioning and then forces the rear end of the top wall to follow a circular path in an guided manner the rest of the way. Thereby, the initial operation of collapsing the top wall down along the corresponding side wall 1 is facilitated. The same advantage ia obtained when the top wall in the terminal phase is pushed in position on top of the container.

The guiding of the top wall described above effectively ensures that the operator can, handle the top wall easily and effortlessly back and forth between its final position on top of the container and its position bent down along the first side wall.

In the final position, the top section is locked to the side sections by means of catches on top of the side sections and rearmost on the top wall.

On the upper bar 11 of the side wall 2 are attached two angular catches 40 having an upper flange 41 extending close across the front end bar 27 of the top wall in the final position of che top wall on top of the container.

On the rearmost end bar 28 of the top wall are furthermore placed two angular catches 42 extending with a lower flange 43 close in under the upper bar 11 of the side wall 1.

On the upper bar 11 of the side wall 3 is a catch in form of a hook 44, and on upper bar 22 of the door 14 is a second catch in form of a corresponding hook 45. In the horizontal flange 32 on each of the two angular side bars 26 of the top wall are made two inclined slots 46 for accommodating the hooks 45 in and near the final position of the top wall.

In the final combined pivoting and displacing movement of the top wall, the foremost of the end bars 27 of the top wall is pushed in under the upper flange 41 on the angular catches 40 topmost on the left side wall 2. The catches 40 at the same time create a stop to further displacement of the top wall.

The lower flange 43 on the two angular catches 42 on the rearmost end bar 28 of the top wall furthermore grasps below the upper bar 11 of the right side wall 1. Just as the catches 42, the catches 43 create a stop for further displacement of the top wall.

The catches 44,45 on the rearmost side wall 3 and the door 14 respectively furthermore lock the top wall 6 to the side walls 3 and 4 which at the same time are pulled together tightly due to the inclined position of the slots 46.

As it can be seen, the top wall 6 is now locked to the side walls 1,2,3,4 in vertical direction. The top wall is furthermore locked to the side walls 3 and 4 in horizontal direction and to the side walls 1. and 2 in the horizontal direction in which the top wall is guided to its final position. A lock 47 and lock fittings 48 interacting with this lock on the side wall 2 serve for locking the top wall to the side walls 2 and 3 against displacement in the opposite direction.

The lock fittings 48 more precisely consist of an angle 49 placed on the upper bar 11 of the side wall 2 and with an upper flap 50, extending across the front end bar 27 of this top wall units the final position. On the top side of this flap is placed a dowel 51.

Figure 7:
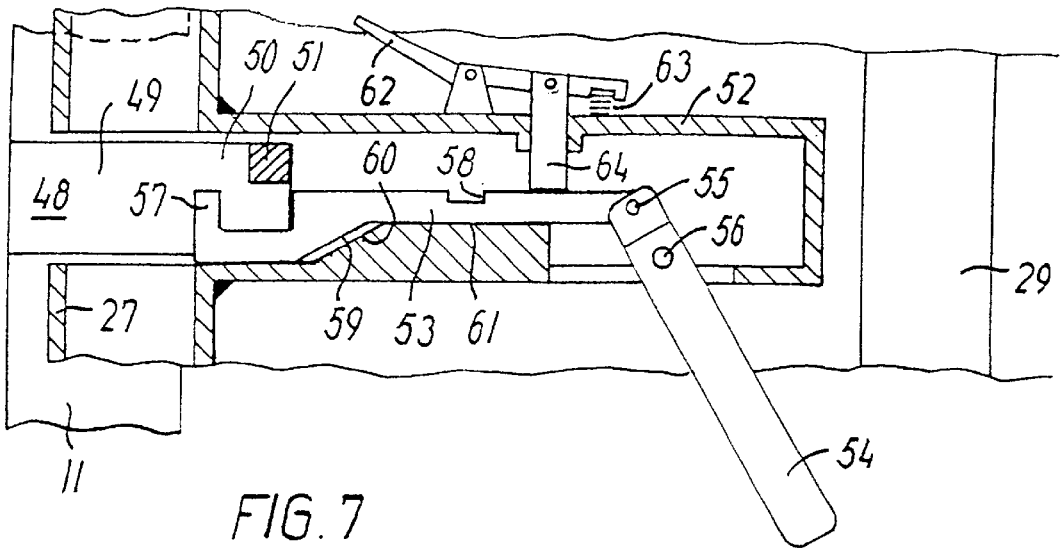
FIG. 7 shows a lock for locking the top section to the rest of the container in a first locking phase.
Figure 8:
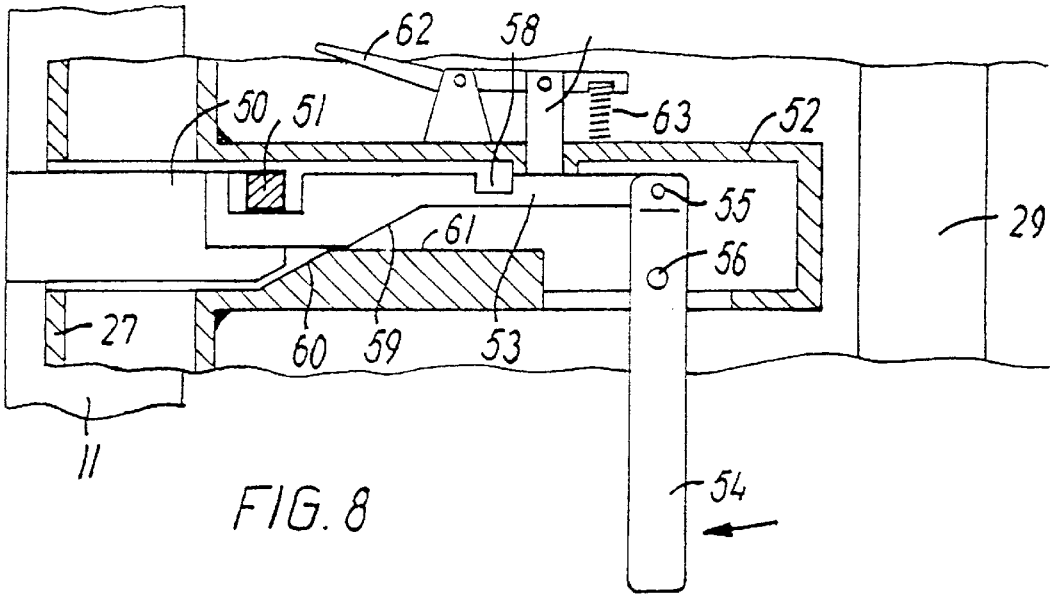
FIG. 8 shows the lock in FIG. 7 in a second locking phase.
Figure 9:
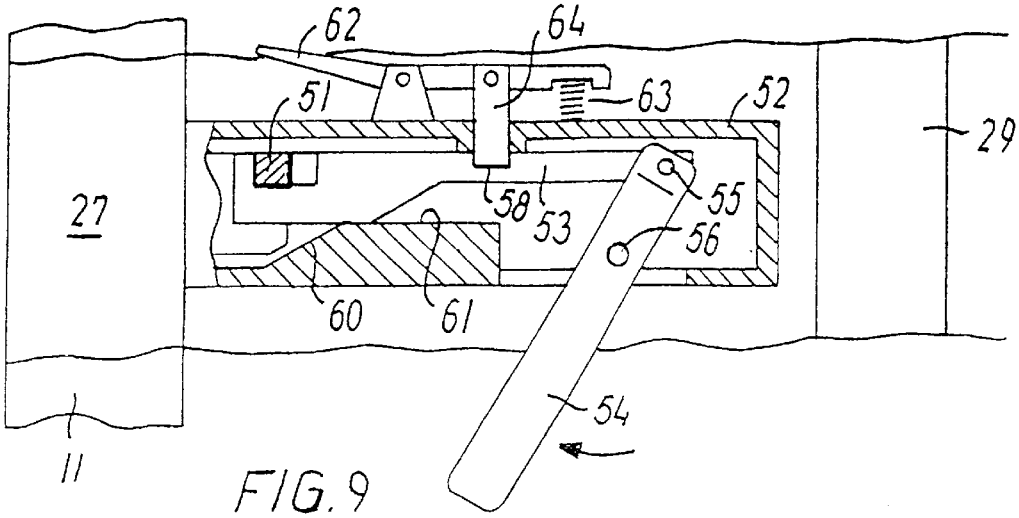
FIG. 9 shows the lock in FIG. 7 in a final locking phase.

The locking arrangement can be seen in detail in FIGS. 7, 8 and 9. The lock 47 is built into a U-shaped housing 52 attached on top of the top wall. In order to better illustrate the locking mechanism, the top wall of the housing is removed from the drawing.

In the housing is placed a specially designed barrel bolt 53 which can be displaced back and forth in the housing by operating a handle 54 connected to the barrel bolt 53 pivotally about a swivel pin 55 and to the housing 52 pivotally about a second swivel pin 56.

On the end of the barrel bolt 53 Opposite the swivel pin 55 is made a catch 57 and at a distance from this a stop 58. On the opposite side, the barrel bolt has an inclined slide face 59 whereas on the housing is made a corresponding inclined slide face 60 that passes into a straight slide face 61.

Furthermore, on the housing is pivotally mounted a key 62 which by means of a tension spring 63 presses a locking pin 64 down towards the barrel bolt 53.

In FIG. 7, the barrel bolt 53 is pushed in under the dowel 51 while the top wall was guided in position on top of the container. During this operation, the barrel bolt was held down by the locking pin 64 so that the catch 57 of the barrel bolt was able to pass under the locking pin.

By pulling the handle 54 in the direction of the arrow, the inclined slide face 59 of the barrel bolt slides up along the inclined slide face 60 of the housing as shown in FIG. 8. Thereby, the catch of the barrel. Bolt is lifted so that by further pulling the handle in the direction of the arrow, it engages the dowel 51 and thereby pulls the side walls 1 and 2 together.

When the stop 58 passes the locking pin 64, this pin snaps down behind the stop 58 and locks the lock. The top wall is now locked to the side wall 1,2,3,4 in all horizontal directions and as mentioned earlier, also in vertical direction.

When the container is to be collapsed again, the key 62 is pressed down whereby the locking of the lock is discontinued. The top wall can then be pulled free as described earlier, and the container can be collapsed.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. Collapsible container for transporting a load comprising:

at least one base section having four side edges;

a first, second, third and fourth side section, each of which having top edges and being pivotally connected to one of side edges of the base section along each top edge, a top section which is pivotally connected to the first side section, wherein the base, sides and top sections are pivotally associated with each other for movement between a first position in which they are in rows extending substantially parallel across each other, and a second position in which they jointly define a chamber for containing a load, and wherein the top section is constructed as an unbroken top wall which in the second position extends between the top edges of the side sections, the top wall being adapted to both pivot and displacing move when it is guided between its second position and a third position in which the top wall extends substantially parallel to the first side section in the second position of this side section, the top wall is connected to the first side section by means of at least one guide rod pivotally connected at one end to the first side section and at the other end to an area at the side of the top wall that adjoins the top side of the first side section when the top wall and the first side section are in their second position.

2. The collapsible container according to claim 1, wherein the base section is rectangular.

3. The collapsible container according to claim 1, further comprising at least one slide associated with the top wall, said slide extending in the same direction as the movement of the top wall when it is guided between its second and third position, and a pivoting guide is pivotally mounted topmost on the first side section for displaceably accommodating said slide.

4. The collapsible container according to claim 1, wherein a guide rod is pivotally placed substantially in the middle of each of the upright sides of the first side section in the second position and an angular pivoting guide is pivotally placed topmost on each of these sides for each displaceably accommodating a slide constructed on the top wall.

5. The collapsible container according to claim 4, wherein the slide is constructed in the form of a projecting flange, and the corresponding pivoting guide has an angular cross-section having two legs, one leg of the pivoting guide extending across the flange while the other leg is pivotally connected to the upright side bar of the first side wall in the second position.

6. The collapsible container according to claims 5, wherein the pivotal engagement of the at least one guide rod with the top wall takes place by an axle journal constructed on the guide rod and pivotally journaled in a bearing in form of a U-shaped clamp placed on the underside of the top wall and having a greater length than the transverse size of the axle journal.

7. The collapsible container according to claim 5, wherein at least one catch is placed on the top wall, said catch engaging with an area topmost on the first section in the second position of the top wall and fixing the top wall in relation to this, and at least one second catch is placed topmost on at least one of the other side sections, said catch engaging with the top section and fixing this in relation to the respective side section.

8. The collapsible container according to claim 7, wherein the at least one catch on at least one of the two side sections extends transversely in the direction in which the top wall is moving when it is guided between the second and third position and is formed as a hook that in the second position is extends up through a slot made in the projecting flange of the top wall.

9. The collapsible container according to claim 8, wherein the slot extends obliquely outwardly in relation to the direction in which the top wall is moving when it is guided from the third to the second position.

10. Collapsible container according to claim 1, wherein a lock is placed on the top wall and lock fittings are placed topmost on the opposite side of the first side section, and the lock and lock fittings are adapted to engage each other in the second position in such a way that the lock fittings are pulled in towards the lock when activated.

* * * * *